US010993505B1

(12) United States Patent
Boxberger

(10) Patent No.: US 10,993,505 B1
(45) Date of Patent: May 4, 2021

(54) FLEXIBLE MAGNETIC FASTENING APPARATUS

(71) Applicant: Frank Dale Boxberger, Scottsdale, AZ (US)

(72) Inventor: Frank Dale Boxberger, Scottsdale, AZ (US)

( * ) Notice: Subject to any disclaimer, the term of this patent is extended or adjusted under 35 U.S.C. 154(b) by 56 days.

(21) Appl. No.: 16/555,091

(22) Filed: Aug. 29, 2019

(51) Int. Cl.

| | |
|---|---|
| ***A41F 1/00*** | (2006.01) |
| ***H01F 7/02*** | (2006.01) |
| ***A44B 1/12*** | (2006.01) |
| ***A44B 99/00*** | (2010.01) |

(52) U.S. Cl.
CPC ..... *A44B 1/12* (2013.01); *A44B 99/00* (2013.01); *H01F 7/0252* (2013.01); *A41F 1/002* (2013.01); *A44D 2203/00* (2013.01)

(58) Field of Classification Search
CPC ..... A44B 1/12; H01F 7/0252
See application file for complete search history.

(56) References Cited

U.S. PATENT DOCUMENTS 2,389,298 A * 11/1945 Ellis ..... A41F 1/002 335/303
2,959,832 A * 11/1960 Baermann ..... E05C 19/161 24/303
3,161,932 A * 12/1964 Seymour ..... A41F 1/002 24/303
3,710,291 A * 1/1973 Nicoud ..... H02K 1/17 335/306
3,727,658 A * 4/1973 Eldridge, Jr. ..... A61B 50/362 206/370
3,998,004 A * 12/1976 Ehrlich ..... A63H 33/046 446/92
4,462,596 A * 7/1984 Yamamoto ..... A63F 3/00694 273/239
5,682,653 A * 11/1997 Berglof ..... G09F 1/10 24/303
6,226,842 B1 * 5/2001 Wong ..... A41F 1/002 24/303
6,301,754 B1 * 10/2001 Grunberger ..... A41F 1/002 24/303
6,749,480 B1 * 6/2004 Hunts ..... A63H 33/046 446/85
6,969,294 B2 * 11/2005 Vicentelli ..... A63F 9/34 446/129
7,154,363 B2 * 12/2006 Hunts ..... H01F 7/0242 335/306

(Continued)

*Primary Examiner* — Jason W San
(74) *Attorney, Agent, or Firm* — Plager Schack LLP; Mark H. Plager; Naomi Mann

(57) ABSTRACT

A flexible magnetic fastening apparatus with enhanced strength and reduced noise during use is provided. The magnetic fastening apparatus includes an upper fastener detachably coupled to a lower fastener. Each fastener in the upper and lower fasteners has a fabric layer that encapsulates a magnetic member. The magnetic member in each fastener has a positive magnetic pole at the bottom surface of the fabric layer and a negative magnetic pole at the top surface of the fabric layer. The negative magnetic pole of the magnetic member in the lower fastener attracts the positive magnetic pole of the magnetic member in the upper fastener, thereby coupling the bottom surface of the upper fastener to the top surface of the lower fastener.

12 Claims, 6 Drawing Sheets

(56) References Cited

U.S. PATENT DOCUMENTS

| | | | | |
|---|---|---|---|---|
| 8,100,735 | B2 * | 1/2012 | Park | A63H 33/046 446/92 |
| 8,187,006 | B2 * | 5/2012 | Rudisill | H01R 11/30 439/39 |
| 8,662,298 | B2 * | 3/2014 | Aldana | A45C 11/00 206/320 |
| 9,782,687 | B2 * | 10/2017 | Bagley | A63H 33/046 |
| 10,395,631 | B1 * | 8/2019 | Boxberger | G10H 1/0555 |
| 10,497,349 | B1 * | 12/2019 | Boxberger | G10D 3/04 |
| 10,621,964 | B1 * | 4/2020 | Boxberger | G10H 1/348 |
| 10,629,349 | B2 * | 4/2020 | Naftali | A45C 13/1069 |
| 10,819,075 | B1 * | 10/2020 | Boxberger | H02J 50/70 |
| 10,857,475 | B2 * | 12/2020 | Moskowitz | A63H 33/044 |
| 2009/0139065 | A1 * | 6/2009 | Roche | B43L 1/008 24/303 |
| 2009/0289090 | A1 * | 11/2009 | Fullerton | A45F 5/02 224/183 |
| 2012/0216374 | A1 * | 8/2012 | Manuello | A41F 1/002 24/303 |
| 2013/0111710 | A1 * | 5/2013 | Hunts | H01F 7/0242 24/303 |
| 2015/0230565 | A1 * | 8/2015 | Fuhrman | A44C 5/2071 24/303 |
| 2016/0037868 | A1 * | 2/2016 | Lambert | A44B 11/25 24/303 |
| 2016/0195117 | A1 * | 7/2016 | Yeh | F16M 11/041 24/303 |

* cited by examiner

FLEXIBLE MAGNETIC FASTENING APPARATUS

BACKGROUND

The embodiments herein relate generally to fasteners. More specifically, embodiments of the invention are directed to a flexible magnetic fastening apparatus.

In today's world, there are many different types of fasteners used in clothing, bags, and backpacks to name a few. Snaps, buttons, zippers, and hook and loop fasteners have become the norm. Fashion will always have a place for many of these fasteners due to their appeal in the industry. Hook and loop fasteners have become a staple in many of today's products due to their lightweight nature and cost.

However, these fasteners have several limitations. In particular, hook and loop fasteners can wear out over time and are noisy when pulled apart from each other. In hunting and military applications, hook and loop fasteners have become a staple in clothing and gear such as cases and bags. In these applications, silence is crucial. In hunting, it could mean the difference between landing a trophy animal or not. In the military, it could be a matter of life or death. Other existing fasteners such as snaps, buttons, zippers and other fastening components similarly are limited due to their noise during use. Further, several of these fasteners are not efficiently operated such as in the case of zippers because the user has to align rows of teeth together to operate the slider. Other fasteners such as buttons are not durable because they frequently fall off the clothing, apparel or bag used.

As such, there is a need in the industry for a flexible magnetic fastening apparatus that addresses the limitations of the prior art, which provides a fastener with enhanced strength that reduces the amount of noise generated during use. There is a further need for the flexible magnetic fastening apparatus to engage and disengage with enhanced efficiency.

SUMMARY

In certain embodiments of the invention, a flexible magnetic fastening apparatus with enhanced strength and reduced noise during use is provided. The magnetic fastening apparatus comprises a pair of fasteners comprising an upper fastener detachably coupled to a lower fastener, each fastener in the upper and lower fasteners comprising a fabric layer that encapsulates a magnetic member so that the fabric layer forms a top surface and a bottom surface, the magnetic member in each fastener in the upper and lower fasteners comprising a positive magnetic pole at the bottom surface of the fabric layer and a negative magnetic pole at the top surface of the fabric layer, wherein the negative magnetic pole of the magnetic member in the lower fastener attracts the positive magnetic pole of the magnetic member in the upper fastener, thereby coupling the bottom surface of the upper fastener to the top surface of the lower fastener.

In an alternative embodiment, the magnetic member in the upper fastener comprises a central portion having a positive magnetic pole in contact with the bottom surface of the fabric layer and an outer portion having a negative magnetic pole in contact with the bottom surface of the fabric layer. In this embodiment, the magnetic member in the lower fastener comprises a central portion having a negative magnetic pole in contact with the top surface of the fabric layer and an outer portion having a positive magnetic pole in contact with the top surface of the fabric layer.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
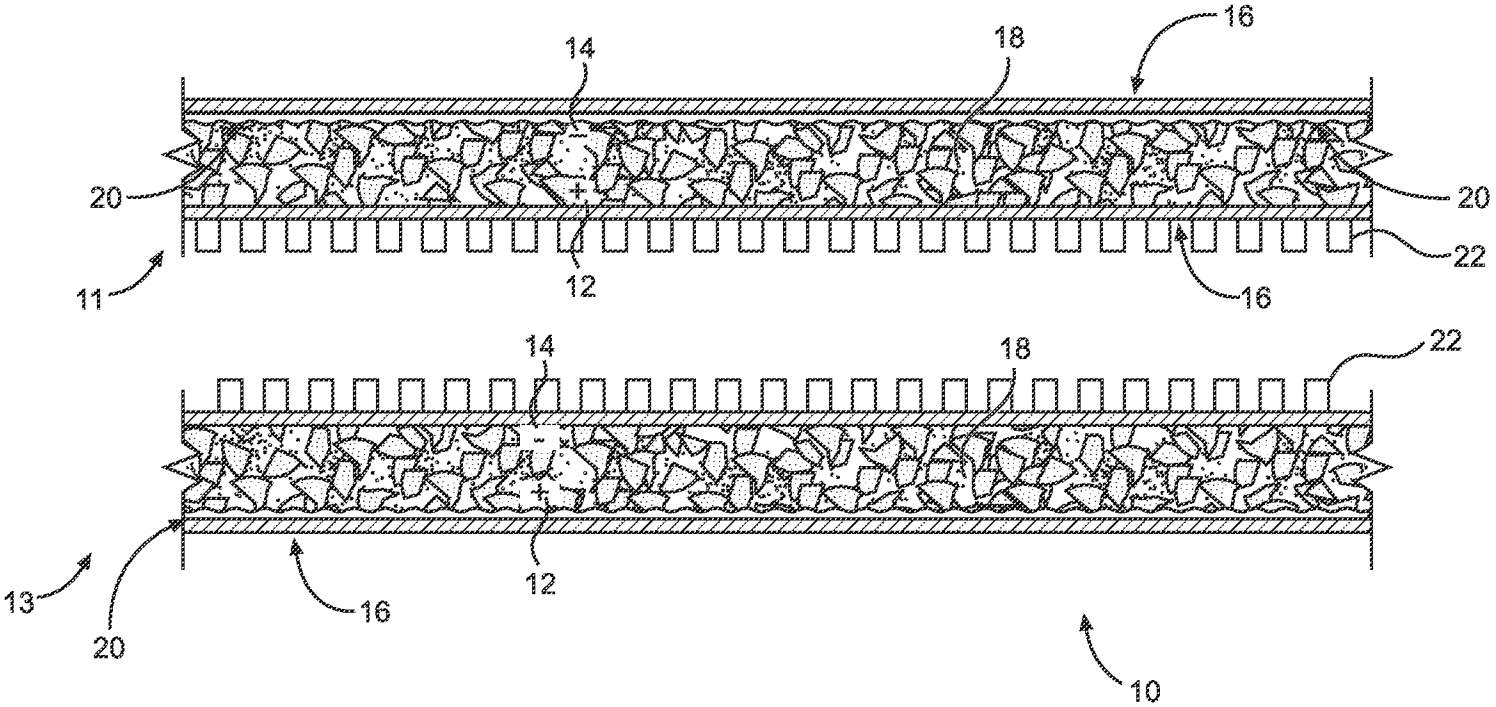
FIG. 1 depicts a cross-sectional view of certain embodiments of the flexible magnetic fastening apparatus.

In certain embodiments as depicted in FIG. 1, magnetic fastening apparatus 10 comprises upper fastener 11 that is configured to couple to lower fastener 13. In one embodiment, each fastener in upper and lower fasteners 11, 13 comprises fabric layer 16 disposed around magnetic member 18. Magnetic member 18 is a rare earth magnet such as a neodymium magnet or other type of magnet. Fabric layer 16 comprises any type of flexible, non-conductive and non-ferrous material including, but not limited to, canvas, wool, cotton or synthetic materials.

In each fastener, fabric layer 16 is disposed entirely around magnetic member 18 and secured to itself using stitching. This encapsulates magnetic member 18 within fabric layer 16. It shall be appreciated that staples, snap components or other fasteners can be used instead in alternative embodiments to secure fabric layer 16 to itself. In an alternative embodiment, each fastener in upper and lower fasteners 11, 13 can be formed by using multiple fabric layers 16 that are coupled together.

In one embodiment as depicted in FIG. 1, magnetic member 18 within each fastener 11, 13 comprises a plurality of crushed magnetic members secured within fabric layer 16 by adhesive 20. The plurality of crushed magnetic members are oriented so that positive magnetic poles of the crushed magnetic members face bottom surface 12 of fabric layer 16 and negative magnetic poles of the crushed magnetic members face top surface 14 of fabric layer 16. In an alternative embodiment, it shall be appreciated that the magnetic poles of the plurality of crushed magnets can be arranged in the opposite direction relative to bottom and top surfaces 12, 14 on fabric layer 16, i.e, positive magnetic poles of the crushed magnetic members face top surface 14 of fabric layer 16 and negative magnetic poles of the crushed magnetic members face bottom surface 12 of fabric layer 16.

In one embodiment, protrusions 22 are coupled to bottom surface 12 of upper fastener 11. Similarly, protrusions 22 are coupled to top surface 14 of lower fastener 13. Protrusions 22 may comprise various shapes and sizes, and be made from any materials including, but not limited to, plastic, rubber and other materials. Protrusions 22 are coupled to fabric layer 16 of upper and lower fasteners 11, 13 using an adhesive or alternative fasteners.

In operation, upper and lower fasteners 11, 13 are oriented and coupled together so that bottom surface 12 of upper fastener 11 contacts top surface 14 of lower fastener 13. The positive magnetic poles of the crushed magnetic members in upper fastener 11 attract the negative magnetic poles of the crushed magnetic members in lower fastener 13 to firmly secure upper and lower fasteners 11, 13 together. Upper and lower fasteners 11, 13 can be easily attached or detached from each other by placing the fasteners together or pulling them apart. In the attached position, protrusions 22 of upper fastener 11 interlock with protrusions 22 of lower fastener 13. This prevents lateral movement of upper fastener 11 relative to lower fastener 13 and detachment of upper and lower fasteners 11, 13 from one another.

Upper and lower fasteners 11, 13 can be attached to any apparel, bags, equipment or other items as desired. Since upper and lower fasteners 11, 13 are made from flexible fabric layer 16 and a plurality of crushed magnetic members, the fasteners can conform to variable shaped items with ease.

Figure 4:
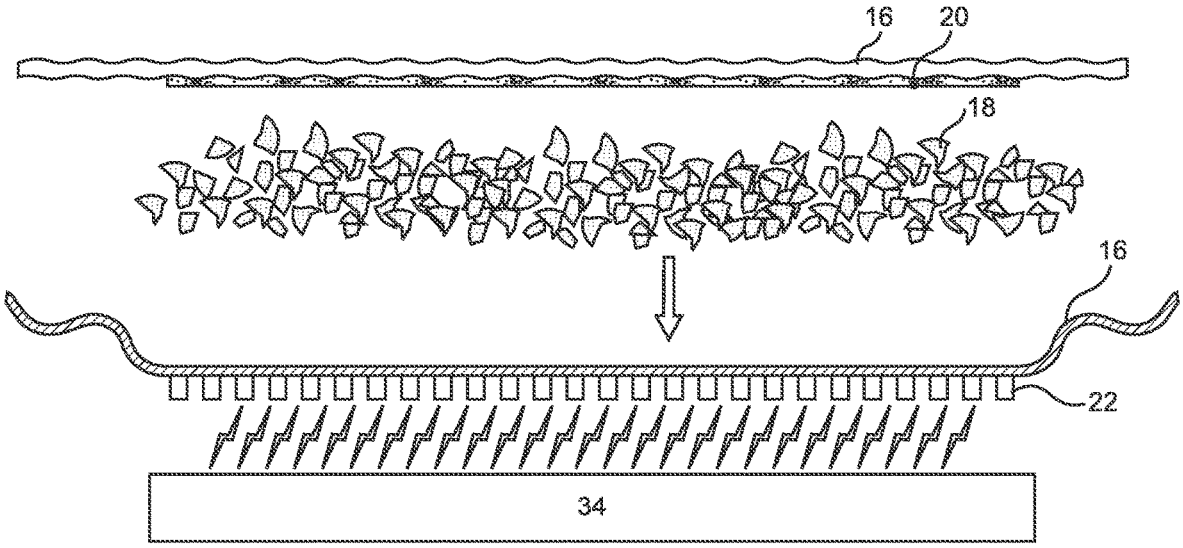
FIG. 4 depicts an exploded view of certain embodiments of the flexible magnetic fastening apparatus illustrating the manufacturing process of the apparatus.
Figure 5:
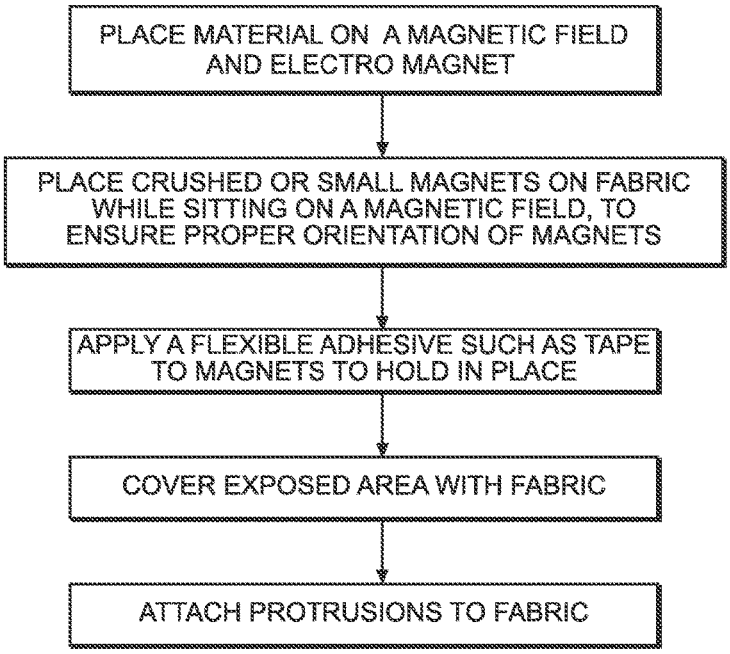
FIG. 5 depicts a flowchart of a method for manufacturing the flexible magnetic fastening apparatus in accordance with certain embodiments of the invention.

In certain embodiments as depicted in FIGS. 4-5, the method of manufacturing magnetic fastening apparatus 10 is illustrated. In one embodiment, the method comprises one or more of the following exemplary steps. First, a material such as fabric layer 16 is disposed in a magnetic field generated by electromagnet 34. Magnetic member 18 in the form of crushed or small magnets are disposed on fabric layer 16.

Electromagnet 34 is adjusted so that its top surface facing fabric layer 16 comprises a positive or negative magnetic pole. This selected magnetic polarity allows the plurality of crushed or small magnets on fabric layer 16 to align with the same orientation and magnetic pole facing fabric layer 16. A flexible adhesive 20 such as tape is disposed on the plurality of crushed or small magnets to maintain the orientation of the magnetic members.

The exposed tape is covered with fabric layer 16. This is accomplished by either wrapping the prior fabric layer 16 around the crushed or small magnets of magnetic member 18 and securing it to itself or securing another fabric layer 16 to the prior fabric layer 16 to encapsulate magnetic member 18. In one embodiment, protrusions 22 are coupled to fabric layer 16 if desired.

Figure 2A:
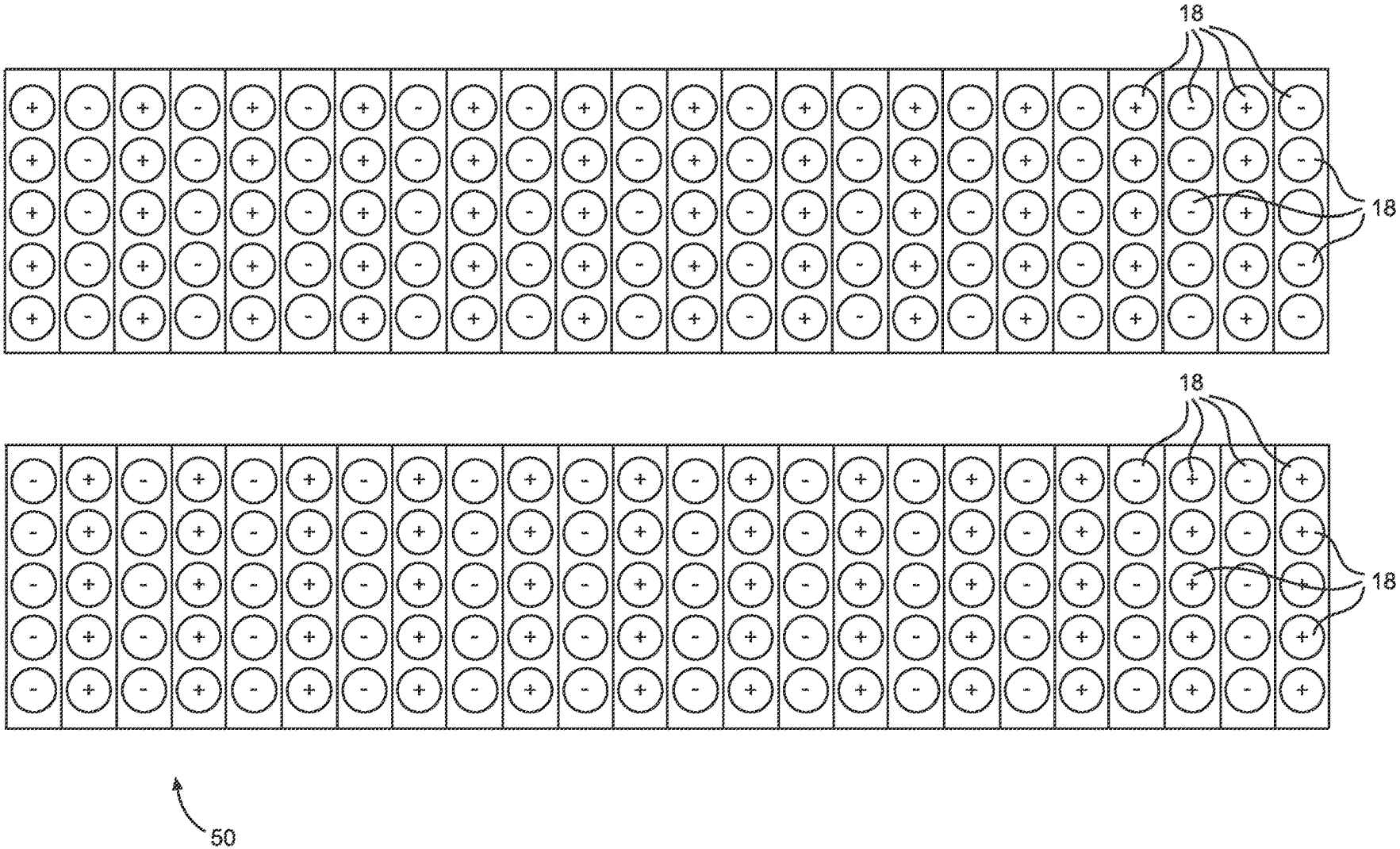
FIG. 2A depicts a top planar view of a first alternative embodiment of the flexible magnetic fastening apparatus.
Figure 2B:
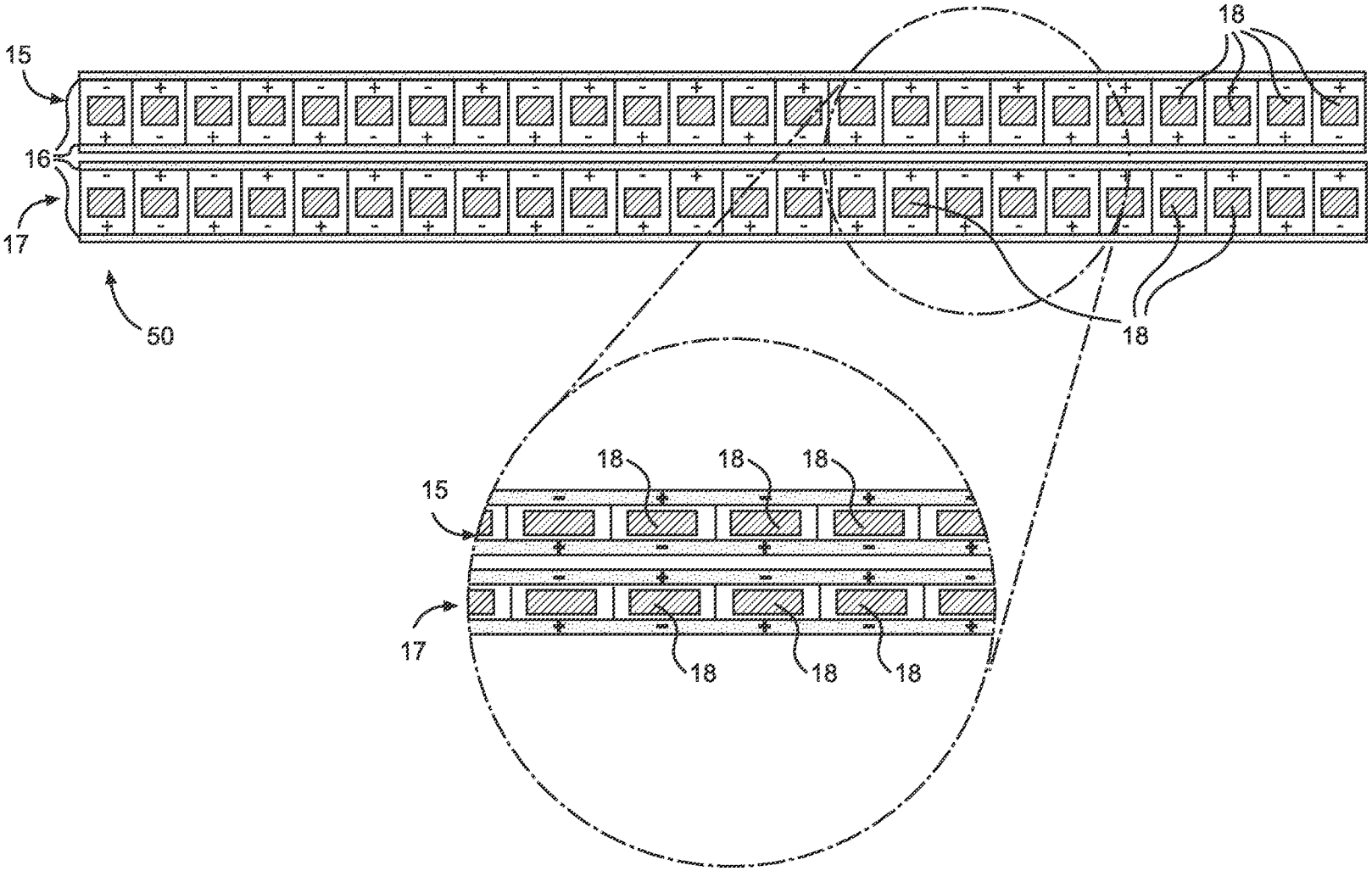
FIG. 2B depicts a cross-sectional view of the first alternative embodiment of the flexible magnetic fastening apparatus.

It shall be appreciated that various modifications can be made to magnetic fastening apparatus 10. In an alternative embodiment as depicted in FIGS. 2A-2B, first alternate magnetic fastening apparatus 50 comprises first alternate upper fastener 15 and first alternate lower fastener 17, which comprise the same components of magnetic fastening apparatus 10 including one or more fabric layers 16 and a plurality of magnetic members 18.

In one embodiment, a plurality of magnetic members 18 are arranged in a plurality of sets of magnetic members within fabric layer 16 with each set of magnetic members oriented in an opposite magnetic pole orientation from each adjacent set of magnetic members. This orientation of magnetic members 18 in first alternate upper and lower fasteners 15, 17 prevents the upper and lower fasteners from sliding laterally relative to each other when the upper and lower fasteners are connected together. It shall be appreciated that any number of magnetic members 18 and sets of magnetic members can be used in first alternate upper and lower fasteners 15, 17.

Figure 3A:
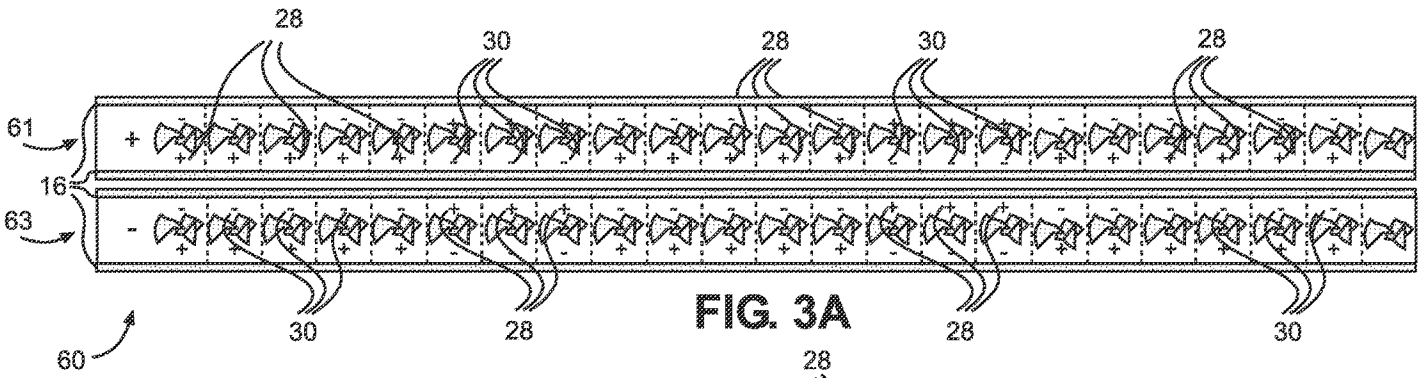
FIG. 3A depicts a cross-sectional view of a second alternative embodiment of the flexible magnetic fastening apparatus.
Figure 3B:
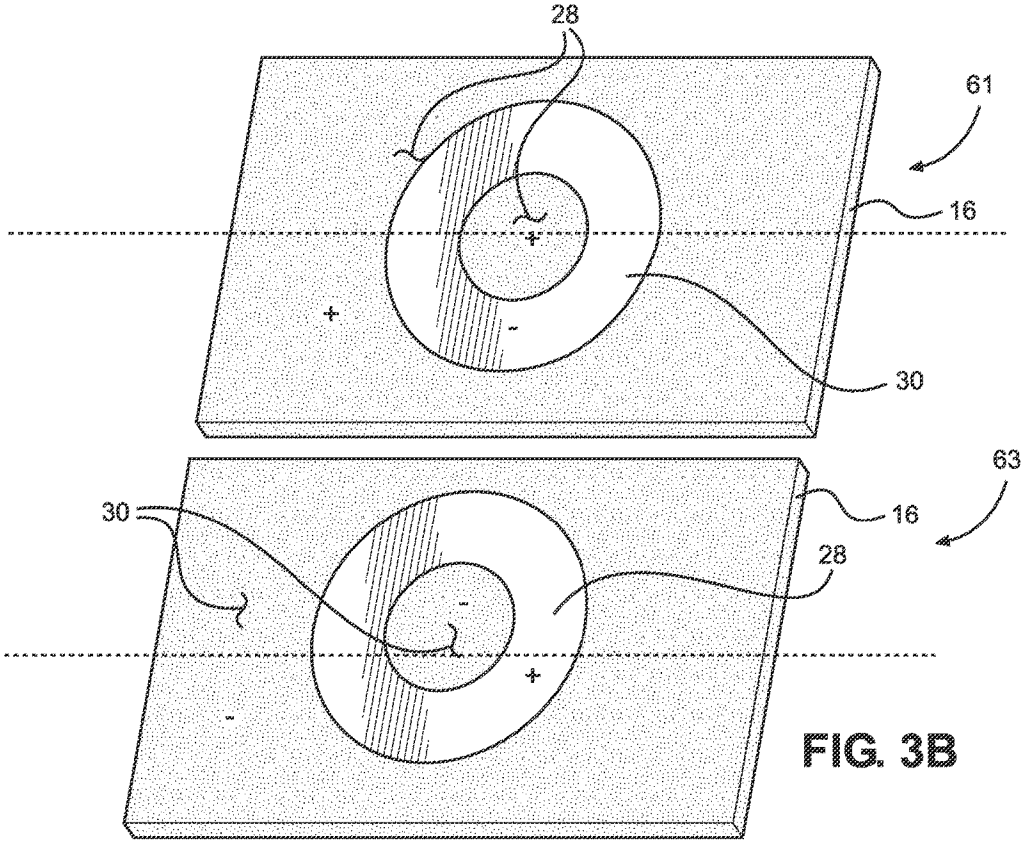
FIG. 3B depicts a perspective view of the second alternative embodiment of the flexible magnetic fastening apparatus.

In an alternative embodiment as depicted in FIGS. 3A-3B, second alternate magnetic fastening apparatus 60 comprises second alternate upper fastener 61 and second alternate lower fastener 63, which comprise the same components of magnetic fastening apparatus 10 including one or more fabric layers 16 and a plurality of magnetic members 18.

In one embodiment as depicted in FIG. 3B, second alternate upper fastener 61 comprises a plurality of magnetic members 18 encapsulated within fabric layer 16 and arranged so that the face of the fastener directed toward second alternate lower fastener 63 comprises central and outer regions having positive magnetic pole surfaces 28 and a ring region having negative magnetic pole surface 30. Second alternate lower fastener 63 comprises a plurality of magnetic members 18 encapsulated within fabric layer 16 and arranged so that the face of the fastener directed toward second alternate upper fastener 61 comprises central and outer regions having negative magnetic pole surfaces 30 and a ring region having positive magnetic pole surface 28.

In operation, second alternate upper and lower fasteners 61, 63 are coupled together as depicted in FIG. 3A. Positive magnetic pole surfaces 28 in second alternate upper fastener 61 attract negative magnetic pole surfaces 30 in second alternate lower fastener 63. Negative magnetic pole surface 30 in the ring region of second alternate upper fastener 61 attracts positive magnetic pole surface 28 in the ring region of second alternate lower fastener 63. The orientation of the engagement surfaces of second alternate upper and lower fasteners 61, 63 allows the upper fastener to rotate 360 degrees relative to the lower fastener. As a result, second alternate magnetic fastening apparatus 60 is beneficial in applications such as mounting a camera to a tripod, where it is desirable to rotate the camera relative to the tripod to a desired target.

Figure 6A:
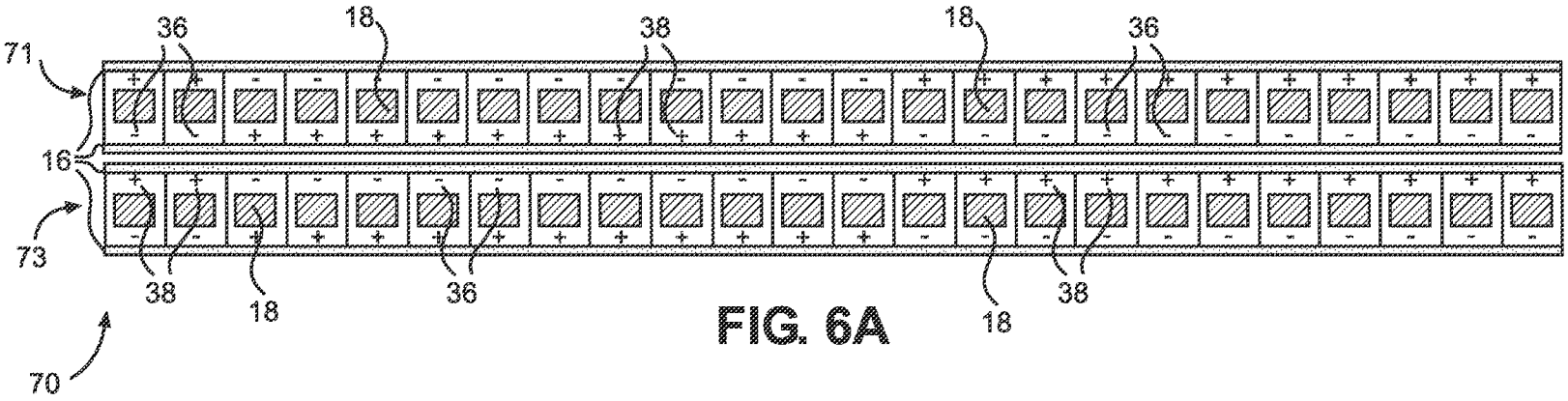
FIG. 6A depicts a cross-sectional view of a third alternative embodiment of the flexible magnetic fastening apparatus.
Figure 6B:
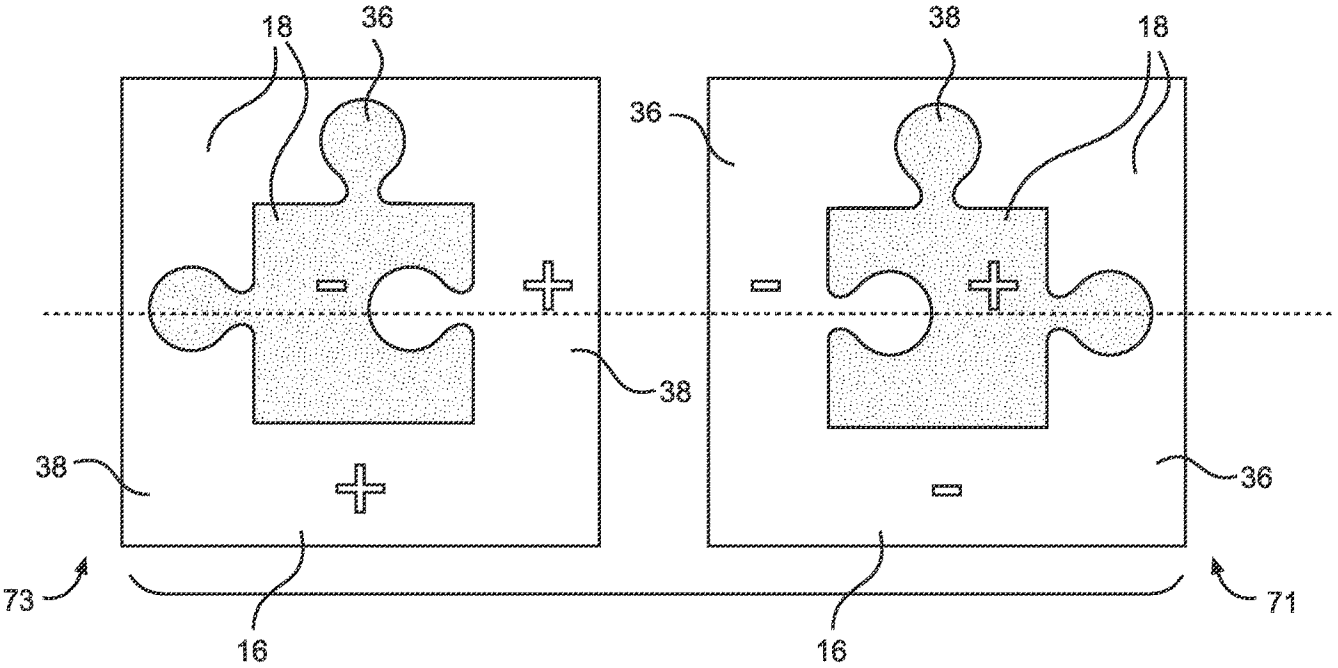
FIG. 6B depicts a top view of the third alternative embodiment of the flexible magnetic fastening apparatus illustrating the orientation of the magnetic members.

In an alternative embodiment as depicted in FIGS. 6A-6B, third alternate magnetic fastening apparatus 70 comprises third alternate upper fastener 71 and third alternate lower fastener 73, which comprise the same components of magnetic fastening apparatus 10 including one or more fabric layers 16 and a plurality of magnetic members 18. In one embodiment, the plurality of magnetic members 18 of each fastener comprises a plurality of crushed magnets that are coupled to the one or more fabric layers 16 by an adhesive.

In one embodiment as depicted in FIG. 6B, third alternate upper fastener 71 comprises a plurality of magnetic members 18 encapsulated within fabric layer 16 and arranged so that the face of the fastener directed toward second alternate lower fastener 73 comprises a central region having positive magnetic pole surface 38 and an outer region having negative magnetic pole surface 36. Third alternate lower fastener 73 comprises a plurality of magnetic members 18 encapsulated within fabric layer 16 and arranged so that the face of the fastener directed toward second alternate upper fastener 71 comprises a central region having negative magnetic pole surface 36 and an outer region having positive magnetic pole surface 38.

In one embodiment as depicted in FIG. 6B, the central regions of third alternate upper and lower fasteners 71, 73 comprise jigsaw puzzle piece-shaped perimeters. It shall be appreciated that each jigsaw puzzle piece-shaped perimeter may comprise any number of female and male members. In an alternative embodiment, it shall be appreciated that the central regions of third alternate upper and lower fasteners 71, 73 can have variable shapes.

In operation, third alternate upper and lower fasteners 71, 73 are coupled together as depicted in FIG. 6A. As depicted in FIGS. 6A-6B, the central region of the upper fastener having positive magnetic pole surface 38 attracts the central region of the lower fastener having negative magnetic pole surface 36. The outer region of the upper fastener having negative magnetic pole surface 36 attracts the outer region of the lower fastener having positive magnetic pole surface 38.

The specific shape of the central and outer regions of each fastener in third alternate upper and lower fasteners 71, 73 ensures the upper and lower fasteners consistently engage together in the same orientation every time. Further, this arrangement also prevents the upper fastener from rotating relative to the lower fastener. As a result, third alternate magnetic fastening apparatus 70 is beneficial in applications such as mounting a body camera to a law enforcement officer, where it is desirable for the camera to be securely fixed to the user's body and facing forward at all times without rotating or moving out of place.

It shall be appreciated that the flexible magnetic fastening apparatuses described in embodiments of the invention have several advantages. The upper and lower fasteners in these apparatuses are flexible to conform to different shaped surfaces. This allows the magnetic fastening apparatuses to be used in a wide variety of applications and items. Since magnetic members are used in the apparatuses, the upper and lower fasteners can be engaged and disengaged relative to each other efficiently with little to no noise. Further, the use of magnetic members in the apparatuses enhances the durability of the upper and lower fasteners, as there are no components that excessively rub or slide against each other during use.

It shall be appreciated that the components of the flexible magnetic fastening apparatus described in several embodiments herein may comprise any alternative known materials in the field and be of any color, size and/or dimensions. It shall be appreciated that the components of the flexible magnetic fastening apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A flexible magnetic fastening apparatus with enhanced strength and reduced noise during use, the magnetic fastening apparatus comprising:

a pair of fasteners comprising an upper fastener detachably coupled to a lower fastener, each fastener in the upper and lower fasteners comprising at least one flexible fabric layer that encapsulates a magnetic member so that the fabric layer forms a top surface of the fastener and a bottom surface of the fastener, the magnetic member in each fastener in the upper and lower fasteners comprising a magnetic pole of a first polarity at the bottom surface of the fastener and a magnetic pole of a second polarity at the top surface of the fastener;

wherein the magnetic pole of the second polarity of the magnetic member in the lower fastener attracts the magnetic pole of the first polarity of the magnetic member in the upper fastener, thereby coupling the bottom surface of the upper fastener to the top surface of the lower fastener, wherein the magnetic member in the upper and lower fasteners comprises a plurality of crushed magnetic members which are non-powdered, the plurality of crushed magnetic members in each fastener in the upper and lower fasteners comprising magnetic poles of the first polarity facing the bottom surface of the fastener and magnetic poles of the second polarity facing the top surface of the fastener, wherein a flexible adhesive is disposed on the plurality of crushed magnetic members in the upper and lower fasteners to maintain a fixed magnetic polarity in the upper and lower fasteners, and wherein each fastener in the upper and lower fasteners is a flexible, fabric covered piece.

2. The magnetic fastening apparatus of claim 1, wherein each magnetic member in the upper and lower fasteners is coupled to the fabric layer by the flexible adhesive, the flexible adhesive being tape.

3. The magnetic fastening apparatus of claim 1, wherein the crushed magnetic members essentially fill a volume of each of said upper and lower fasteners.

4. The magnetic fastening apparatus of claim 3, further comprising a first set of non-magnetic protrusions coupled to the fabric layer of the bottom surface of the upper fastener and a second set of non-magnetic protrusions coupled to the fabric layer of the bottom surface of the lower fastener, wherein the first and second sets of protrusions interlock with each other to prevent lateral movement of the upper and lower fasteners when coupled together.

5. The magnetic fastening apparatus of claim 4, wherein the fabric layer in the upper and lower fasteners is made from a non-conductive material selected from the group consisting of canvas, wool, cotton and synthetic material.

6. A flexible magnetic fastening apparatus with enhanced strength and reduced noise during use, the magnetic fastening apparatus comprising:

a pair of fasteners comprising an upper fastener detachably coupled to a lower fastener, each fastener in the upper and lower fasteners comprising at least one fabric layer that encapsulates a magnetic member so that the fabric layer forms a top surface and a bottom surface of each fastener, the magnetic member in the upper fastener comprising a central portion forming a magnetic pole of a first polarity at the bottom surface of the upper fastener and an outer portion forming a magnetic pole of a second polarity at the bottom surface of the upper fastener, the magnetic member in the lower fastener comprising a central portion forming a magnetic pole of a second polarity at the top surface of the lower fastener and an outer portion forming a magnetic pole of the first polarity at the top surface of the lower fastener;

wherein the magnetic pole of the first polarity of the central portion in the magnetic member in the upper fastener attracts the magnetic pole of the second polarity of the central portion in the magnetic member in the lower fastener, and the magnetic pole of the second polarity of the outer portion in the magnetic member in the upper fastener attracts the magnetic pole of the first polarity of the outer portion in the magnetic member in the lower fastener, thereby coupling the bottom surface of the upper fastener to the top surface of the lower fastener, wherein the outer portion in each fastener in the upper and lower fasteners is immediately adjacent to and entirely surrounds the central portion in each fastener, wherein the magnetic member in each fastener in the upper and lower fasteners comprises a plurality of crushed magnetic members which are non-powdered, the plurality of crushed magnetic members in the central portion of each fastener in the upper and lower fasteners comprising magnetic poles of a first polarity facing the bottom surface of the fastener and magnetic poles of the second polarity facing the top surface of the fastener, the plurality of crushed magnetic members in the outer portion of each fastener in the upper and lower fasteners comprising magnetic poles of the second polarity facing the bottom surface of the fastener and magnetic poles of the first polarity facing the top surface of the fastener, wherein a flexible adhesive is disposed on the plurality of crushed magnetic members in the upper and lower fasteners to maintain a fixed magnetic polarity in the upper and lower fasteners, and wherein each fastener in the upper and lower fasteners is a flexible, fabric covered piece.

7. The magnetic fastening apparatus of claim 6, wherein the central portion in each magnetic member in the upper and lower fasteners comprises a jigsaw puzzle piece-shaped perimeter, configured to prevent rotation between the upper and lower fasteners.

8. The magnetic fastening apparatus of claim 7, wherein each magnetic member in the upper and lower fasteners is coupled to the fabric layer by the adhesive.

9. The magnetic fastening apparatus of claim 8, wherein the plurality of crushed magnetic members essentially fill a volume of each of said upper and lower fasteners.

10. The magnetic fastening apparatus of claim 9, wherein the fabric layer in the upper and lower fasteners is made from a non-conductive material selected from the group consisting of canvas, wool, cotton and synthetic material.

11. The flexible magnetic fastening apparatus of claim 1, wherein each of said pair of fasteners is formed by disposing the fabric layer forming the bottom surface of the fastener in a magnetic field of a desired polarity; disposing the plurality of crushed magnetic members on the fabric layer forming the bottom surface of fastener, wherein the crushed magnetic members are caused to align according to the polarity of the magnetic field; disposing said adhesive on the plurality of crushed magnetic members; and covering the plurality of crushed magnetic members with the fabric layer forming the top surface of the fastener.

12. The magnetic fastening apparatus of claim 6, wherein the central portion in the upper and lower fasteners forms an enclosed circle, and wherein the outer portion in the upper and lower fasteners forms a ring around the enclosed circle, for enabling rotation while maintaining magnetic attachment between the fasteners.

* * * * *